US009072355B1

(12) United States Patent
Magnani

(10) Patent No.: US 9,072,355 B1
(45) Date of Patent: Jul. 7, 2015

(54) SHARABLE HAIR ACCESSORY

(71) Applicant: Nicole Irene Magnani, Staten Island, NY (US)

(72) Inventor: Nicole Irene Magnani, Staten Island, NY (US)

( * ) Notice: Subject to any disclaimer, the term of this patent is extended or adjusted under 35 U.S.C. 154(b) by 0 days.

(21) Appl. No.: 14/283,369

(22) Filed: May 21, 2014

Related U.S. Application Data

(60) Provisional application No. 61/828,754, filed on May 30, 2013.

(51) Int. Cl.

| | |
|---|---|
| ***A45D 8/20*** | (2006.01) |
| ***A45D 8/00*** | (2006.01) |
| ***A45D 8/24*** | (2006.01) |
| *A45D 8/12* | (2006.01) |

(52) U.S. Cl.
CPC ... *A45D 8/20* (2013.01); *A45D 8/12* (2013.01); *A45D 8/24* (2013.01)

(58) Field of Classification Search
CPC ..... A45D 8/20; A45D 8/00; A45D 8/12; A45D 8/14; A45D 8/16; A45D 8/22; A45D 8/24; A45D 8/26; A45D 8/28; A45D 8/30; A45D 8/32; A45D 8/34; A45D 8/36; A45D 8/38; A45D 2008/345; A45D 24/00; A45D 24/04; A45D 24/10
USPC ..... 132/277, 212, 126–136, 138–146, 148, 132/151, 273, 275, 276, 278–284, 200; 24/299–303, 316–319, 324, 326, 359, 24/578.13, 578.14, 487, 489, 543; D28/39–43
See application file for complete search history.

(56) References Cited

U.S. PATENT DOCUMENTS

| | | | | |
|---|---|---|---|---|
| 1,823,361 | A * | 9/1931 | Hudson | 132/128 |
| 1,911,451 | A * | 5/1933 | Kropac | 132/128 |
| 5,494,060 | A | 2/1996 | Potut | |
| 5,533,533 | A | 7/1996 | Shing | |
| 5,884,371 | A * | 3/1999 | Huggins | 24/300 |
| 5,988,184 | A * | 11/1999 | Shu | 132/277 |
| 6,123,086 | A * | 9/2000 | Kuglen | 132/275 |
| 6,189,542 | B1 * | 2/2001 | Shepard | 132/273 |
| 6,453,911 | B1 | 9/2002 | Silva | |
| 6,513,535 | B1 | 2/2003 | Lane | |
| 6,520,495 | B1 * | 2/2003 | La Mendola | 269/45 |
| 6,536,446 | B2 | 3/2003 | Kimura | |
| D473,014 | S | 4/2003 | Shyu | |
| D473,015 | S | 4/2003 | Shyu | |
| D473,016 | S | 4/2003 | Shyu | |
| D473,342 | S | 4/2003 | Shyu | |
| D473,678 | S | 4/2003 | Shyu | |
| D474,307 | S | 5/2003 | Silva | |

(Continued)

*Primary Examiner* — Vanitha Elgart
(74) *Attorney, Agent, or Firm* — Goldstein Law Offices, P.C.

(57) ABSTRACT

A hair accessory that separates into a plurality of fully functional smaller hair accessories, the smaller accessories for sharing with another or rearranging hair into a different style. The hair accessory is a hair clip having a handle coupled to a clip portion with a spring. The hair clip has a plurality of members that separate into individual hair clips, each member fully functional as a hair clip. When the members connect, the hair accessory performs as a unified device. When the members selectively separate, each member performs separately in a manner indistinguishable from the unified accessory, each member having a smaller capacity for holding hair together but functioning in the same manner. The connectors can be, but not limited to, magnets, bead and socket, tongue and groove, and hook and post. The members align end to end or in an overlapping arrangement.

17 Claims, 8 Drawing Sheets

(56) References Cited

U.S. PATENT DOCUMENTS

| | | | | |
|---|---|---|---|---|
| D476,112 | S | 6/2003 | Denebeim | |
| 6,581,611 | B2 | 6/2003 | Sartena | |
| 6,591,843 | B1 | 7/2003 | Langohr | |
| 6,609,524 | B2 | 8/2003 | Lloyd | |
| 6,612,312 | B2 | 9/2003 | Silva | |
| 6,622,734 | B1 | 9/2003 | Bielinski et al. | |
| D480,509 | S | 10/2003 | Yasuda | |
| 6,629,536 | B1 | 10/2003 | Lane | |
| 6,631,538 | B1 * | 10/2003 | Carr | 24/299 |
| 6,647,991 | B2 | 11/2003 | Silva | |
| D483,151 | S | 12/2003 | Walker et al. | |
| D483,522 | S | 12/2003 | Leslie | |
| D483,523 | S | 12/2003 | Jones | |
| D483,524 | S | 12/2003 | Walker et al. | |
| 6,668,841 | B1 | 12/2003 | Chou | |
| 6,681,778 | B1 | 1/2004 | Salisbury et al. | |
| 6,681,779 | B2 | 1/2004 | Stachowski | |
| D486,605 | S | 2/2004 | Walker et al. | |
| 6,691,717 | B2 | 2/2004 | Silva | |
| 6,701,937 | B2 | 3/2004 | Janouch et al. | |
| 6,708,696 | B2 | 3/2004 | Ferguson | |
| D488,258 | S | 4/2004 | Walker et al. | |
| D488,587 | S | 4/2004 | Puorro | |
| D493,013 | S * | 7/2004 | Stachowski | D28/42 |
| D493,572 | S * | 7/2004 | Stachowski | D28/42 |
| D497,689 | S | 10/2004 | Winn et al. | |
| D501,276 | S | 1/2005 | LaFauci et al. | |
| 6,959,713 | B2 | 11/2005 | Silva | |
| 7,003,811 | B2 | 2/2006 | Canavan | |
| 7,021,317 | B1 | 4/2006 | Nathaniel | |
| 7,044,141 | B2 | 5/2006 | Yasuda | |
| 7,066,185 | B2 | 6/2006 | Hildebrandt | |
| D526,442 | S | 8/2006 | Kim | |
| D529,231 | S | 9/2006 | Lau | |
| D536,132 | S | 1/2007 | Vergona | |
| 7,162,750 | B2 | 1/2007 | Canavan | |
| 7,174,899 | B2 | 2/2007 | Lane | |
| 7,174,902 | B2 | 2/2007 | Rizzuto | |
| 7,195,020 | B2 | 3/2007 | Bird | |
| D540,982 | S | 4/2007 | Vergona | |
| D540,983 | S | 4/2007 | Vergona | |
| D541,983 | S | 5/2007 | Au | |
| 7,213,602 | B2 | 5/2007 | Silva | |
| 7,222,627 | B1 | 5/2007 | Johns | |
| 7,222,631 | B2 | 5/2007 | Silva | |
| 7,258,123 | B2 | 8/2007 | Silva | |
| D554,288 | S | 10/2007 | Vergona | |
| D554,290 | S | 10/2007 | Zandt | |
| 7,278,432 | B2 * | 10/2007 | Lane | 132/128 |
| 7,296,580 | B1 | 11/2007 | Sbardella | |
| 7,299,808 | B2 | 11/2007 | Lau | |
| 7,305,995 | B2 | 12/2007 | Tojo et al. | |
| D561,394 | S | 2/2008 | Pichon | |
| D562,498 | S | 2/2008 | Vergona | |
| 7,325,551 | B2 | 2/2008 | Henninger et al. | |
| 7,325,552 | B1 | 2/2008 | Wilkie | |
| 7,331,353 | B2 | 2/2008 | Harvie | |
| 7,337,786 | B2 | 3/2008 | Sonstegard et al. | |
| D566,895 | S | 4/2008 | Vergona | |
| 7,373,940 | B1 | 5/2008 | Lloyd | |
| RE40,462 | E | 8/2008 | Vogel | |
| D580,099 | S | 11/2008 | Pichon | |
| D580,100 | S | 11/2008 | Pichon | |
| D580,101 | S | 11/2008 | Pichon | |
| D580,102 | S | 11/2008 | Pichon | |
| D580,103 | S | 11/2008 | Pichon | |
| D580,104 | S | 11/2008 | Pichon | |
| D580,105 | S | 11/2008 | Pichon | |
| D583,991 | S | 12/2008 | Pichon | |
| D583,992 | S | 12/2008 | Pichon | |
| D583,993 | S | 12/2008 | Pichon | |
| D583,994 | S | 12/2008 | Pichon | |
| D583,995 | S | 12/2008 | Pichon | |
| D583,996 | S | 12/2008 | Pichon | |
| 7,461,661 | B2 | 12/2008 | Chudzik et al. | |
| 7,461,662 | B2 | 12/2008 | Kim | |
| D585,597 | S | 1/2009 | Tsai | |
| D585,598 | S | 1/2009 | Tsai | |
| 7,478,639 | B2 | 1/2009 | Stachowski | |
| D586,041 | S | 2/2009 | Tsai | |
| D586,042 | S | 2/2009 | Tsai | |
| D586,043 | S | 2/2009 | Tsai | |
| D586,503 | S | 2/2009 | Lau | |
| D587,401 | S | 2/2009 | Tsai | |
| 7,484,512 | B2 | 2/2009 | Martinelli et al. | |
| 7,493,903 | B2 | 2/2009 | Rogers et al. | |
| 7,506,653 | B2 | 3/2009 | Gladwin et al. | |
| D590,102 | S | 4/2009 | Hsu | |
| D590,993 | S | 4/2009 | Hsu | |
| D590,994 | S | 4/2009 | Hsu | |
| D591,905 | S | 5/2009 | Pichon | |
| D591,906 | S | 5/2009 | Hsu | |
| D592,803 | S | 5/2009 | Tsai | |
| 7,581,547 | B2 * | 9/2009 | Pena | 132/275 |
| D602,200 | S | 10/2009 | Pichon | |
| 7,596,966 | B2 | 10/2009 | Garvin | |
| D604,902 | S | 11/2009 | Pichon | |
| D605,361 | S | 12/2009 | Hsu | |
| D605,814 | S | 12/2009 | Hsu | |
| 7,631,648 | B2 | 12/2009 | Kirby | |
| 7,631,649 | B2 | 12/2009 | Coral et al. | |
| 7,637,264 | B1 | 12/2009 | Roberson | |
| 7,644,717 | B2 | 1/2010 | Hsu | |
| D614,350 | S | 4/2010 | Tsai | |
| D614,807 | S | 4/2010 | Tsai | |
| D615,702 | S | 5/2010 | Hsu | |
| 7,735,496 | B2 | 6/2010 | Ellegard | |
| 7,735,497 | B2 | 6/2010 | Kim | |
| 7,753,058 | B2 | 7/2010 | Chudzik et al. | |
| 7,766,020 | B2 | 8/2010 | Chininis et al. | |
| 7,789,093 | B2 | 9/2010 | Tojo et al. | |
| D626,619 | S | 11/2010 | Gogol et al. | |
| D626,689 | S | 11/2010 | Shyu | |
| D626,690 | S | 11/2010 | Hsu | |
| D627,099 | S | 11/2010 | Tu | |
| D627,516 | S | 11/2010 | Hsu | |
| D627,928 | S | 11/2010 | Hsu | |
| 7,823,594 | B2 | 11/2010 | Defenbaugh et al. | |
| D635,297 | S | 3/2011 | Hsu | |
| D635,298 | S | 3/2011 | Hsu | |
| D635,715 | S | 4/2011 | Hsu | |
| D640,413 | S | 6/2011 | Tsai | |
| D640,829 | S | 6/2011 | Tsai | |
| D641,103 | S | 7/2011 | Tsai | |
| D642,738 | S | 8/2011 | Hsu | |
| D643,154 | S | 8/2011 | Dumala | |
| 7,992,579 | B2 | 8/2011 | Longoria et al. | |
| 8,011,375 | B2 | 9/2011 | Defenbaugh et al. | |
| 8,047,211 | B2 | 11/2011 | Gladwin et al. | |
| 8,087,416 | B2 | 1/2012 | Defenbaugh et al. | |
| D654,624 | S | 2/2012 | Hsu | |
| D656,273 | S | 3/2012 | Lau | |
| D656,274 | S | 3/2012 | Tsai | |
| 8,166,982 | B2 | 5/2012 | Hsu | |
| 8,225,802 | B2 | 7/2012 | Rogers | |
| D665,532 | S | 8/2012 | Melnikova | |
| D667,167 | S | 9/2012 | Stewart | |
| D667,997 | S | 9/2012 | Stewart | |
| D669,217 | S | 10/2012 | Hsu | |
| 8,307,835 | B2 * | 11/2012 | King | 132/200 |
| 2010/0132729 | A1 * | 6/2010 | Kuglen et al. | 132/107 |
| 2011/0048439 | A1 * | 3/2011 | Young | 132/126 |
| 2011/0120490 | A1 * | 5/2011 | King | 132/210 |
| 2013/0167856 | A1 * | 7/2013 | Baird | 132/130 |

* cited by examiner

SHARABLE HAIR ACCESSORY

CROSS-REFERENCE TO RELATED APPLICATIONS

This application is a nonprovisional utility application of the provisional patent application, Ser. No. 61/828,754 filed in the United States Patent Office on May 30, 2013 and claims the priority thereof and is expressly incorporated herein by reference in its entirety.

TECHNICAL FIELD

The present disclosure relates generally to a hair accessory. More particularly, the present disclosure relates to a hair accessory that separates into a plurality of fully functional hair accessories.

BACKGROUND

Hair accessories are worn for decorative purposes, the accessories both inherently decorative and functional, arranging and keeping hair tresses in a position for a particular hair style or producing a more tidy appearance.

Hair accessories are also worn for comfort, pulling hair away from the face and neck, keeping a wearer cooler by exposing skin for evaporation.

Hair accessories come in many forms. Among the most common are clips, sometimes referred to as butterfly clips. Butterfly clips come in several styles, the clip portion having comblike teeth, plain clamps or a combination of both. Butterfly clips come in simple utilitarian styles as well as highly decorated bling pieces.

While these units may be suitable for the particular purpose employed, or for general use, they would not be as suitable for the purposes of the present disclosure as disclosed hereafter.

In the present disclosure, where a document, act or item of knowledge is referred to or discussed, this reference or discussion is not an admission that the document, act or item of knowledge or any combination thereof was at the priority date, publicly available, known to the public, part of common general knowledge or otherwise constitutes prior art under the applicable statutory provisions; or is known to be relevant to an attempt to solve any problem with which the present disclosure is concerned.

While certain aspects of conventional technologies have been discussed to facilitate the present disclosure, no technical aspects are disclaimed and it is contemplated that the claims may encompass one or more of the conventional technical aspects discussed herein.

BRIEF SUMMARY

An aspect of an example embodiment in the present disclosure is to provide a hair accessory that is sharable with another. Accordingly, an aspect of an example embodiment in the present disclosure provides a hair clip having a plurality of members that separates into a plurality of fully functional smaller hair accessories useful for more than one user.

Another aspect of an example embodiment in the present disclosure is to provide a hair accessory that is operative for rearranging hair into a different style requiring a plurality of hair accessories when one accessory is available. Accordingly, an aspect of an example embodiment in the present disclosure provides one hair clip having a plurality of members that separates into a plurality of fully functional smaller hair accessories.

A further aspect of an example embodiment in the present disclosure is to provide a plurality of hair accessories that is operative for arranging hair into a style that requires a single accessories that is larger than any one of the plurality of hair accessories. Accordingly, an aspect of an example embodiment in the present disclosure provides a plurality of fully functional hair accessories that couple together into a single larger hair accessory that is fully functional for arranging hair.

The present disclosure describes a hair accessory that separates into a plurality of fully functional smaller hair accessories, the smaller accessories for sharing with another or for rearranging hair into a different style. The hair accessory is a hair clip having a handle coupled to a clip portion with a spring. The hair clip has a plurality of members that separate into individual hair clips, each member fully functional as a hair clip. When the members connect, the hair accessory performs as a unified device. When the members 20 selectively separate, each member performs separately in a manner indistinguishable from the unified accessory, each member having a smaller capacity for holding hair together but functioning in the same manner. The connectors can be, but not limited to, magnets, bead and socket, tongue and groove, and hook and post. The members align end to end or in an overlapping arrangement.

The present disclosure addresses at least one of the foregoing disadvantages. However, it is contemplated that the present disclosure may prove useful in addressing other problems and deficiencies in a number of technical areas. Therefore, the claims should not necessarily be construed as limited to addressing any of the particular problems or deficiencies discussed hereinabove. To the accomplishment of the above, this disclosure may be embodied in the form illustrated in the accompanying drawings. Attention is called to the fact, however, that the drawings are illustrative only. Variations are contemplated as being part of the disclosure.

BRIEF DESCRIPTION OF THE DRAWINGS

In the drawings, like elements are depicted by like reference numerals. The drawings are briefly described as follows.

The present disclosure now will be described more fully hereinafter with reference to the accompanying drawings, which show various example embodiments. However, the present disclosure may be embodied in many different forms and should not be construed as limited to the example embodiments set forth herein. Rather, these example embodiments are provided so that the present disclosure is thorough, complete and fully conveys the scope of the present disclosure to those skilled in the art.

DETAILED DESCRIPTION OF THE PREFERRED EMBODIMENTS

Figure 1:
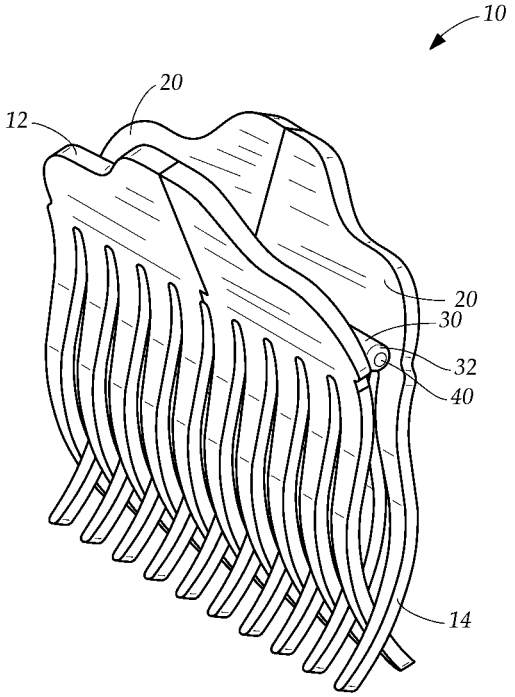
FIG. 1 is diagrammatic perspective view of an example embodiment of a separable hair accessory.

FIG. 1 illustrates a hair accessory 10 for holding hair together, gathering a plurality of hair strands and pulling the hair strands in a unified way to create a hair style, to hold hair away from a face or neck or to sweep and hold hair to a side. The hair accessory 10 in this example embodiment is a hair clip.

Figure 9A:
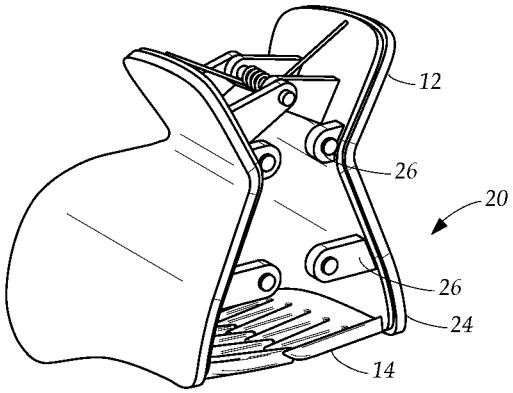
FIG. 9A is a dynamic perspective view of another example embodiment of a first member of the hair accessory.
Figure 9B:
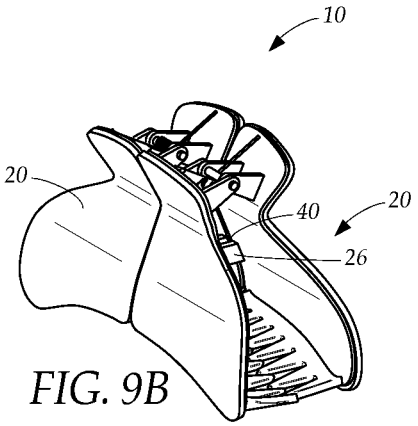
FIG. 9B, similar to FIG. 9A, is a dynamic perspective view of a pair of members coupling to form another example embodiment of the hair accessory.
Figure 9C:
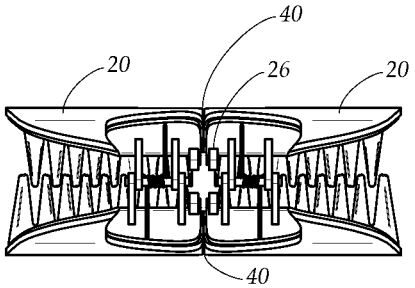
FIG. 9C, similar to FIG. 9C, is a top plan view of another example embodiment of the hair accessory having the members coupled together.

The illustrated example embodiment of the clip has a clip portion with comb-like teeth 14. Other example embodiments have clip portions with clamps. Further example embodiments have both clip portions and comb-like teeth portions as shown in FIGS. 9A-9C and described hereinbelow. One of ordinary skill appreciates that the embodiments described herein are not limitations and the inventive concept is applicable to many example embodiments of hair accessories in addition to those described and illustrated.

Figure 2:
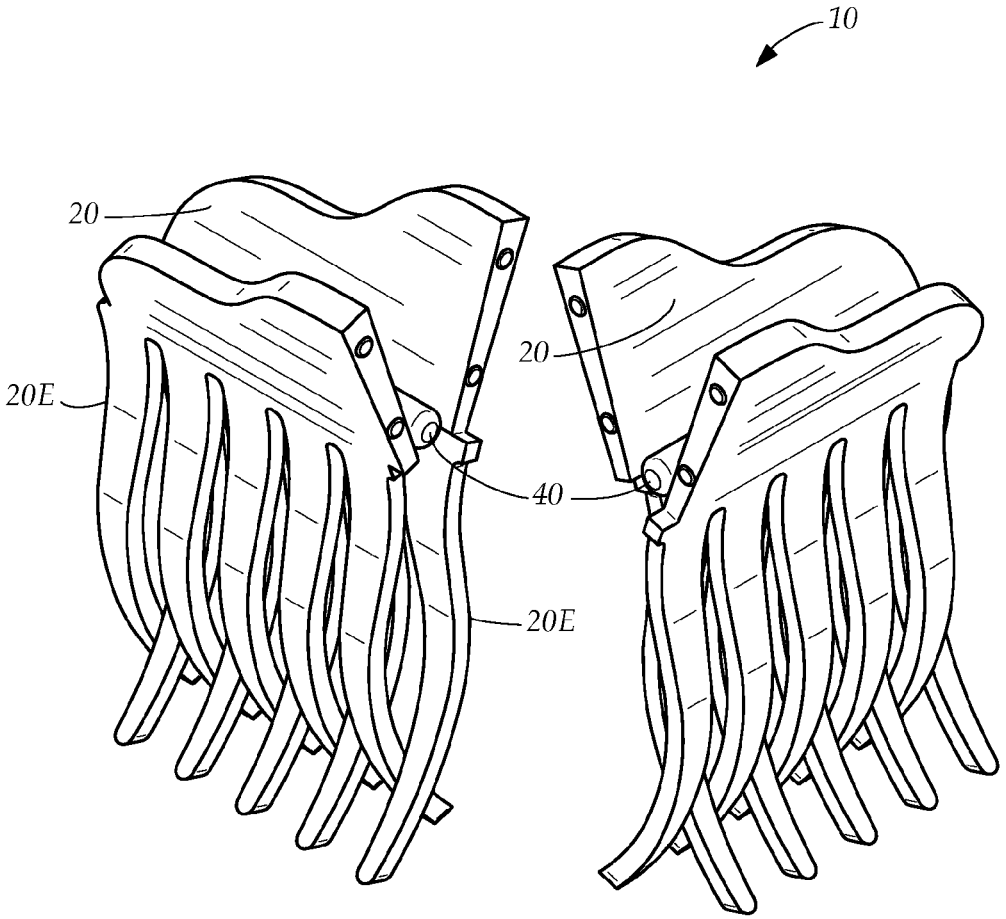
FIG. 2 is diagrammatic perspective view of an example embodiment of the separable hair clip separating into a plurality of hair accessories.

The hair accessory 10 has a plurality of members 20. The members 20 selectively separate, forming a plurality of hair accessories, each member 20 fully operative for pulling and holding hair strands together. When the members 20 connect, as shown in FIG. 1, the hair accessory performs as a unified device. When the members 20 selectively separate, as shown in FIG. 2, each member 20 performs separately in a manner indistinguishable from the unified accessory, each member having a smaller capacity for holding hair strands together but functioning in the same manner.

A first user wears the accessory with the members 20 connected, the first user selectively disconnecting one member 20 and sharing the member 20 with a second user. In another embodiment example, the user rearranges her hair style into a different hair style, placing each member 20 in a separate portion of hair, gathering different portions of hair strands with each member 20.

Figure 8:
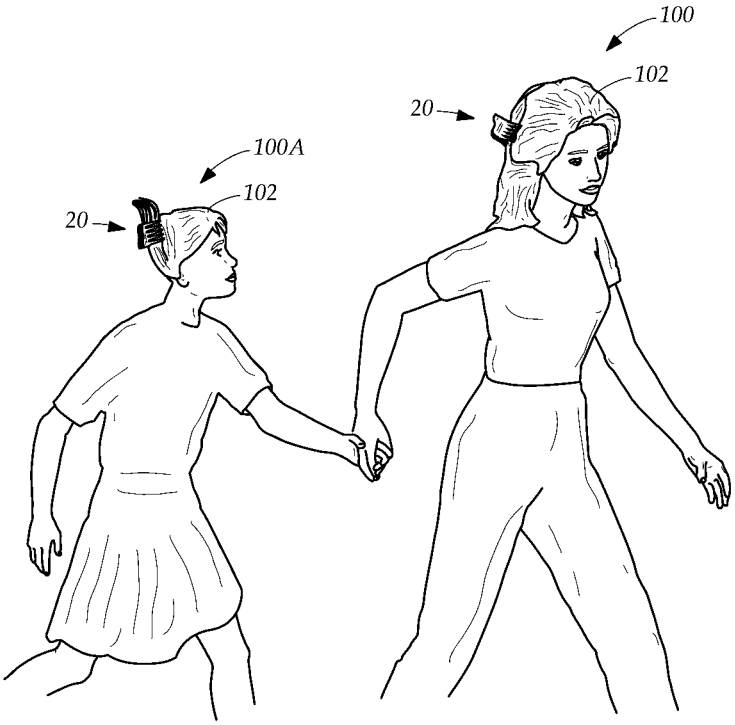
FIG. 8 is a perspective view of a first user wearing the first member of the hair accessory and sharing the second member with a second user.

Referring to FIG. 8, the first user 100 styles her hair 102 using the hair accessory with the members 20 connected. FIG. 8 demonstrates that when the first user 100 desires to share the hair accessory, the user removes the hair accessory from her hair and separates the members 20, using one member 20 to pull back and hold the first user's 100 hair and using a second member 20 to pull back and hold the hair 102 of a second user 100A.

As an illustration, an adult 100 traveling with a child 100A can share the hair accessory when the child 100A is uncomfortable and hot and wants her hair pulled up and held away from the neck and face. Away from home, the adult 100 does not have access to other hair accessories, but can conveniently remove the hair accessory from her own hair, separate the members 20, replace the hair accessory with the first member 20 and place the second member 20 in the child's hair, pulling the child's hair up and holding away from the child's neck and face.

As a further instance as shown in FIG. 2, the user can initially style her hair using the hair accessory 10 with the members 20 connected. Subsequently, the user desires to change the style, but does not have a second hair accessory to effectuate the desired style. The user removes the hair accessory 10 from her hair, separates the members 20 and continues styling her hair into the new style, having a plurality of hair accessories, fully functional to hold hair in the new style.

FIG. 2 further illustrates the members 20 having a pair of side edges 20E, including a first side edge and a second side edge. Referring now to FIGS. 1 and 2 together, the hair accessory 10 has comb-like teeth 14, each member has a spine 30 with a spring 32, the spine 30 having a pair of ends extending between the side edges 20E of each member 20. The spine also includes a spine axis around which each clip member is configured to pivot. At an end of the spine is a connector 40. In a further embodiment, as shown in the drawing, both ends of the spine have a connector 40. In another embodiment, the connectors are on a pair of inside surfaces when the members are connected. FIG. 2 shows the connectors 40 on the inside surfaces of the spring spine ends 32. The connectors 40 are configured for coupling to one another for joining the members 20 such that the spine 30 extends continuously across both clip members 20, as illustrated in FIG. 1, the side edges 20 and the spine axes of each clip member 20 becoming aligned.

Referring again to FIG. 1, the hair accessory 10 has a plurality of clip portions 14 operative for grasping hair, and a plurality of handle portions 12, each of the clip and handle portions having a pair of side edges. The joined clip portions 14 are cooperatively operative for holding hair when connected, each clip portion independently operative for holding hair when disconnected. The handle portion 12 couples to each corresponding clip portion 14, the handle portion operative for opening the clip portion. When the members 20 are coupled, the user can grasp the handle portions of the members simultaneously, so that the accessory 10 functions as a unitary clip.

The hair accessory 10 has the spine 30 coupling each handle portion to the corresponding clip portion. When the handle portions 12 are grasped together, the accessory 10 functions as a single device.

In one embodiment shown in FIG. 1, the spines 30 having ends, each end having the connector 40, align the hair accessory in a straight line, an end of a first spine 30 connecting to an end of a second spine 30, the comb-like teeth 14 extending uniformly across the hair accessory. In a further embodiment, which is not illustrated, the members having handles, and in one variation, the clips and handles having connectors, align in an overlapping arrangement.

Figure 7:
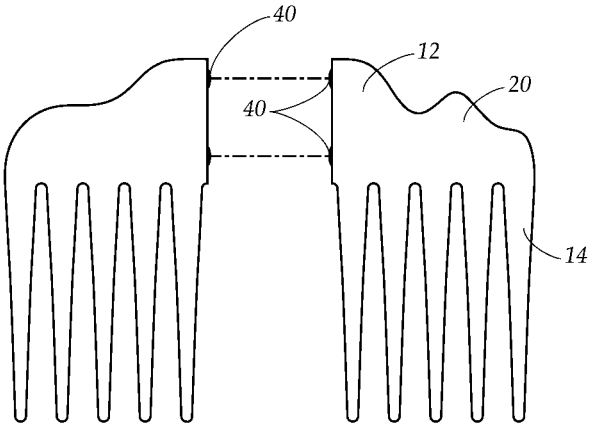
FIG. 7 is a side elevational view of a further example embodiment of the hair accessory separating into the pair of members.

FIG. 7 illustrates the connectors 40 on the handles 12. In the illustrated example embodiment, the handles 12 each have an inside end, the connectors 40 on the insides ends of a pair of handles 12. The members 20 connect at the handles.

In other example embodiment, the clip portion has a clamp having a connector on an outer surface of the clip portion for connecting in an overlapping manner described hereinbelow.

Figure 10:
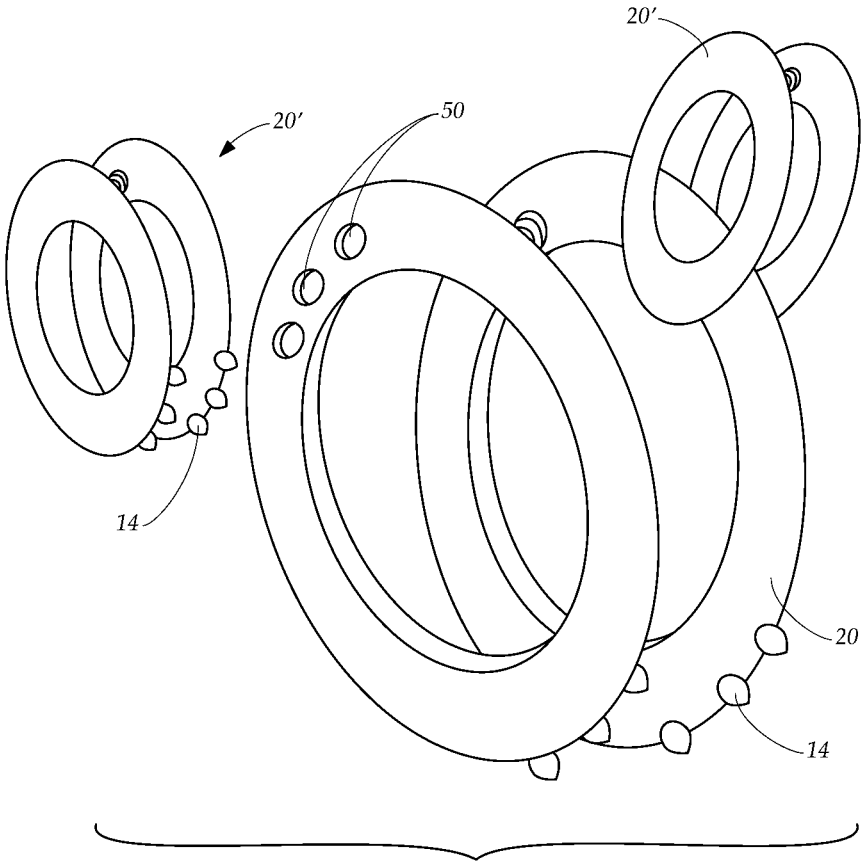
FIG. 10 is a dynamic perspective view of a further example embodiment of the hair accessory separating into a plurality of members.

In other example embodiment shown in FIG. 10, the first member 20 has a plurality of openings 50 on the clip and the second member 20' couples to the first member by inserting the teeth 14 of the second member 20' into the openings 50 on the first member 20'. It is understood that a plurality of second members 20' can be coupled to the first member 20 in this manner.

In other example embodiment shown in FIG. 9A, the member has a handle 12, a clamp 24 having a bottom edge, and comb-like teeth 14 which extend from the bottom edge and interlock for further gripping the hair. The clamp 24 and the coupled handle 12 each have a pair of opposing sides and each side has an arm 26 having a connector 40, an arm 26 on one side of the clamp 24 and an arm on one side of the handle 12. The connectors 40 on the first member 20 is a mirror image of the second member 20 as shown in FIG. 9C. The two members 20 couple to form the accessory 10 wherein the clamps of each member are substantially aligned such that the clamps extend uniformly across the now combined hair accessory, the arms 26 coupling by the connectors 40.

Figure 3A:
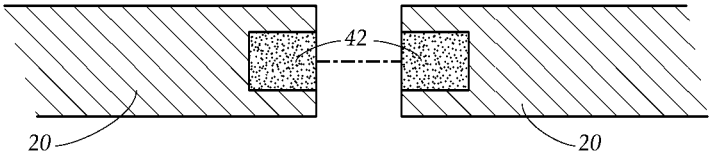
FIG. 3A is a top plan view of an example embodiment of a spine of a separable hair accessory having a plurality of a magnetic connectors.
Figure 3B:
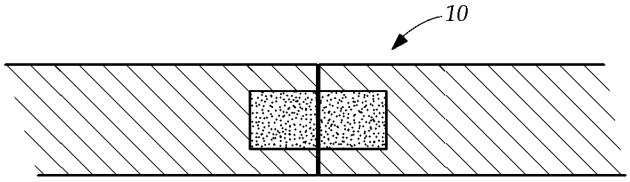
FIG. 3B, similar to FIG. 3A, is a top plan view of an example embodiment of the spine of the separable hair accessory coupling together with magnetic connectors.

FIGS. 3A and 3B demonstrate a pair of connectors, each one a magnet 42. One magnet 42 is on each member 20. In one embodiment, the magnets 42 are on the end of the spine. In a further embodiment, the magnets 42 are on the handle portions. In yet a further embodiments, the magnets 42 are on arms inside the accessory as shown in FIG. 9A. In this embodiment, the members overlap when connected but retain the functionality of the clip. It is understood by those of ordinary skill that the pair of magnets 42 attract each other, a first magnet having opposite polarity than a second magnet.

Figure 4A:
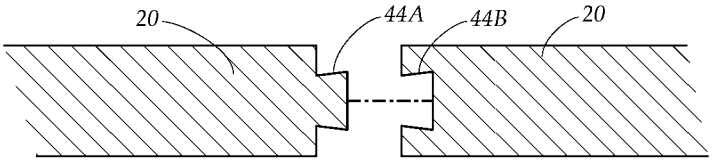
FIG. 4A is a top plan view of an example embodiment of the spine of the separable hair accessory having tongue and groove connectors.
Figure 4B:
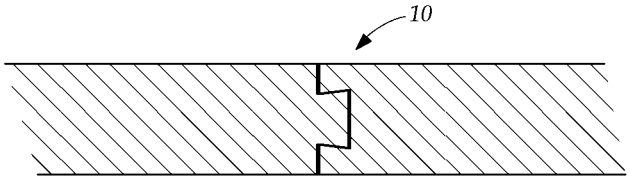
FIG. 4B, similar to FIG. 4A, is a top plan view an example embodiment of of the spine of the separable hair accessory coupling together with the tongue and groove connector.

FIGS. 4A and 4B show a tongue 44A and groove 44B connector pair, the tongue 44A extending outwardly from the end of at least one of a first spine or a first member and the groove extending within the end of at least one of a second spine or a second member. It is understood that assignment of tongue and groove to the members is immaterial to the functioning of the connector pair.

Figure 5A:
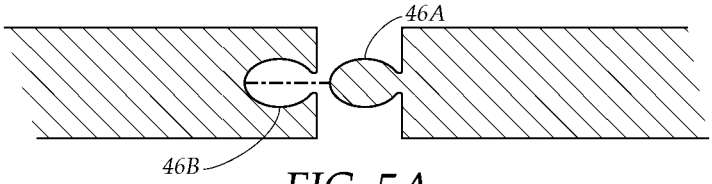
FIG. 5A is a top plan view of an example embodiment of the spine of the separable hair accessory having a bead and socket connector.
Figure 5B:
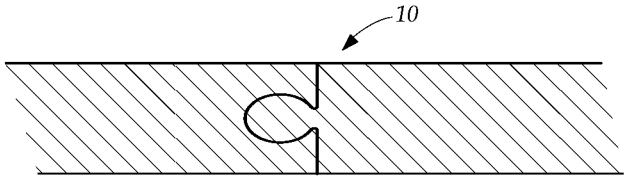
FIG. 5B, similar to FIG. 5A, is a top plan view of an example embodiment of the spine of the separable hair accessory coupling together with the bead and socket connector.

FIGS. 5A and 5B show a bead 46A and socket 46B connector pair. In the drawing, the connector pair is on the spine wherein the bead and the socket are coaxial with the spine axis, a further embodiment, the connector pair is on a clamp of the hair accessory 10 having the handle coupled to the clamp. The clamp on a first member, having an outer surface with the bead connector, and the clamp on a second member has a socket connector operative for accommodating the bead connector, connect in an overlapping manner as explained above.

Figure 6A:
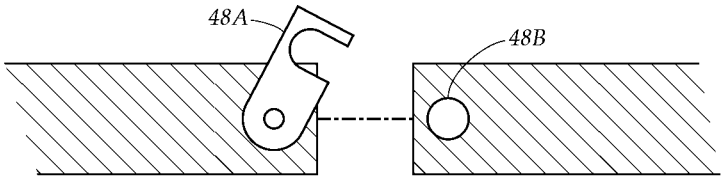
FIG. 6A is a top plan view of an example embodiment of the spine of the separable hair accessory having a hook and post connector.
Figure 6B:
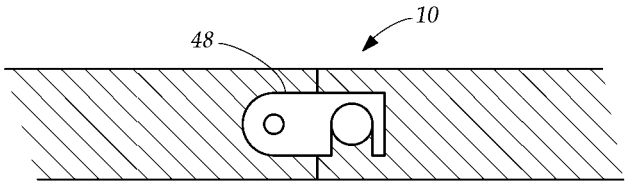
FIG. 6B, similar to FIG. 6A, is a top plan view of an example embodiment of the spine of the separable hair accessory coupling together with the hook and post connector.

FIGS. 6A and 6B show a hook 48A and post 48B connectors wherein the hook is pivotally connected to the spine, the hook having a hook axis substantially perpendicular to the spine axis and the post extends outwardly from the spine substantially perpendicularly to the spine ends. It is understood that this connector pair is not limited to the post, but that other devices such as an eyelet for receiving and securing the hook are possible within the inventive concept.

This disclosure presents example embodiments of connector pairs, however, the disclosure is not limited to the illustrated connectors and that other connector pairs are possible within the inventive concept.

It is understood that when an element is referred hereinabove as being "on" another element, it can be directly on the other element or intervening elements may be present therebetween. In contrast, when an element is referred to as being "directly on" another element, there are no intervening elements present.

Moreover, any components or materials can be formed from a same, structurally continuous piece or separately fabricated and connected.

It is further understood that, although ordinal terms, such as, "first," "second," "third," are used herein to describe various elements, components, regions, layers and/or sections, these elements, components, regions, layers and/or sections should not be limited by these terms. These terms are only used to distinguish one element, component, region, layer or section from another element, component, region, layer or section. Thus, "a first element," "component," "region," "layer" or "section" discussed below could be termed a second element, component, region, layer or section without departing from the teachings herein.

Spatially relative terms, such as "beneath," "below," "lower," "above," "upper" and the like, are used herein for ease of description to describe one element or feature's relationship to another element(s) or feature(s) as illustrated in the figures. It is understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device can be otherwise oriented (rotated 90 degrees or at other orientations) and the spatially relative descriptors used herein interpreted accordingly.

Example embodiments are described herein with reference to cross section illustrations that are schematic illustrations of idealized embodiments. As such, variations from the shapes of the illustrations as a result, for example, of manufacturing techniques and/or tolerances, are to be expected. Thus, example embodiments described herein should not be construed as limited to the particular shapes of regions as illustrated herein, but are to include deviations in shapes that result, for example, from manufacturing. For example, a region illustrated or described as flat may, typically, have rough and/or nonlinear features. Moreover, sharp angles that are illustrated may be rounded. Thus, the regions illustrated in the figures are schematic in nature and their shapes are not intended to illustrate the precise shape of a region and are not intended to limit the scope of the present claims.

In conclusion, herein is presented a hair accessory that separates into a plurality of fully functional hair accessories. The disclosure is illustrated by example in the drawing figures, and throughout the written description. It should be understood that numerous variations are possible, while adhering to the inventive concept. Such variations are contemplated as being a part of the present disclosure.

What is claimed is:

1. A hair accessory, comprising:

a plurality of clip members, each clip member operative for holding hair together, each clip member having a first side edge, a second side edge, and a spine with a spring extending between the first side edge and the second side edge, the spine having a spine axis around which each clip member is configured to pivot, the spine having a pair of ends; and a plurality of connectors, a first connector on an end of the spine of a first clip member and a second connector on an end of the spine of a second clip member, the connectors coupling to each other operative for joining the clip members such that the spines extend continuously across both clip members, the side edges and the spine axes of the clip members becoming aligned, the joined clip members cooperatively operative for holding hair when coupled together, each clip member independently operative for holding hair when detached from another clip member, each clip member performing separately in a manner indistinguishable from the connected hair accessory.

2. The hair accessory as described in claim 1, wherein the connectors are magnets, a first magnet at an end of the spine of the first clip member, and a second magnet at an end of the spine of the second clip member.

3. The hair accessory as described in claim 1, wherein the first connector is a tongue extending outwardly from an end of the spine of the first clip member, the tongue coaxial with the spine axis and the second connector is a groove extending within an end of the spine of the second clip member, the groove coaxial with the spine axis.

4. The hair accessory as described in claim 1, wherein the first connector is a bead extending outwardly from an end of the spine of the first clip member, the bead coaxial with the spine axis and the second connector is a socket extending within an end of the spine of the second clip member the socket coaxial with the spine axis.

5. The hair accessory as described in claim 1, wherein the first connector is a hook pivotally coupled to the spine of the first clip member, the hook having a hook axis substantially perpendicular to the spine axis and the second connector is an eye extending outwardly from the spine of the second clip member substantially perpendicularly to the ends of the spine.

6. The hair accessory as described in claim 1, wherein a plurality of hair strands are cooperatively held by a plurality of interlaced comb teeth, the comb teeth extending downwardly from the spine of each clip member, the comb teeth of the first clip member substantially aligned with the comb teeth of the second clip member such that the comb teeth extend uniformly across the hair accessory.

7. The hair accessory as described in claim 1, wherein a plurality of hair strands are cooperatively held by a plurality of clamps, a clamp extending downwardly from the spine of each clip member, the clamp of the first clip member substantially aligned with the clip of the second clip member such that the clamps extend uniformly across the hair accessory.

8. A hair accessory for holding hair, comprising:

a plurality of clip portions operative for grasping hair, each of the clip portions having a pair of side edges;

a plurality of handle portions, each handle portion having a first side edge and a second side edge, each of the handle portions coupled to one of the clip portions, the handle portion operative for opening the clip portion;

a plurality of spines, each spine having a spring, an axis, and a pair of ends each spine extending between the side edges of a corresponding handle portion and clip portion and coupling the corresponding handle portion and clip portion, each handle portion extending into the corresponding clip portion at the spine; and a plurality of connectors, each connector on an end of the spines, the connectors coupling to each other operative for selectively connecting the clips portions such that the spines extend continuously across the plurality of handle portions and corresponding clip portions, the side edges and the spine axes of the clip portions becoming aligned, the joined clips portions operative for holding hair when connected, each clip portion independently operative for holding hair when disconnected.

9. The hair accessory as described in claim 8, the plurality of spines includes a first spine and a second spine wherein the connectors are magnets, including a first magnet at an end of a first spine, and a second magnet at an end of the second spine.

10. The hair accessory as described in claim 8, the plurality of spines includes a first spine and a second spine wherein a first connector is a tongue extending outwardly from an end of the first spine, the tongue coaxial with the spine axis and a second connector is a groove extending within the end of the second spine, the groove coaxial with the spine axis.

11. The hair accessory as described in claim 8, the plurality of spines includes a first spine and a second spine wherein a first connector is a bead extending outwardly from an end of the first spine, the bead coaxial with the spine axis and a second connector is a socket within an end of the second spine, the socket coaxial with the spine axis.

12. The hair accessory as described in claim 8, the plurality of spines includes a first spine and a second spine wherein a first connector is a hook pivotally coupled to the first spine, the hook having a hook axis substantially perpendicular to the spine axis and a second connector is an eye extending outwardly from the second spine substantially perpendicularly to the ends of the spine.

13. The hair accessory as described in claim 8, wherein each of the clip portions including a plurality of interlaced comb teeth for holding hair, the comb teeth extending downwardly away from each spine, the comb teeth of a first clip portion substantially aligned with the comb teeth of a second clip portion such that the comb teeth extend uniformly across the hair accessory.

14. The hair accessory as described in claim 8, wherein each of the clip portions includes a plurality of clamps, a clamp extending away from its corresponding spine, the clamp of one of the clip portions substantially aligned with the clamp of a another clip portion.

15. A hair accessory for holding a plurality of hair strands together, comprising:

a plurality of members including a first member and a second member, each member having a clamp, the clamp of each member having opposing sides that close shut, operative for grasping hair, each member also having a plurality of handles, a handle coupled to each side of the clamp, the handles operative for opening the clamp;

each member also having a plurality of arms, one pair of arms attaching to each handle and extending inward toward the opposing handle and one pair of arms attaching to the sides of the clamp and extending inward toward the opposing clamp side, a first arm opposite the second arm in each pair of arms; and a plurality of connectors, each connector on an arm, the connectors operative for selectively and directly connecting the first member to the second member when the handle arms and clamp arms of the second member align and are operably coupled to the corresponding handle arms and clamp arms of the first member, the clamp sides of the first member substantially aligned with the clamp sides of the second member, the joined members operative as a unitary accessory for simultaneously holding hair when connected, each member independently operative for holding hair in a manner indistinguishable from the joined members when disconnected.

16. The hair accessory as described in claim 15, wherein the connectors are magnets.

17. The hair accessory as described in claim 16, wherein the clamp of the first member is a first clamp and the clamp of the second member is a second clamp, each clamp has a bottom edge, the bottom edge having comb-like teeth on each opposing side orthogonal to the bottom edge, the comb-like teeth facing inward, the comb-like teeth on a first side interlocking with the comb-like teeth on a second opposing side, the comb teeth of the first clamp substantially aligned with the comb teeth of the second clamp such that the comb teeth extend uniformly across the hair accessory.

* * * * *